US006582261B2

(12) United States Patent
Kanno

(10) Patent No.: US 6,582,261 B2
(45) Date of Patent: Jun. 24, 2003

(54) ANTI-THEFT DEVICE FOR WATER VEHICLE

(75) Inventor: Isao Kanno, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/068,351

(22) Filed: Feb. 5, 2002

(65) Prior Publication Data

US 2002/0151230 A1 Oct. 17, 2002

(30) Foreign Application Priority Data

Feb. 5, 2001 (JP) ..... 2001-028537

(51) Int. Cl.[7] ..... B63H 21/00

(52) U.S. Cl. ..... 440/84; 180/287; 307/10.2; 307/10.3; 440/85

(58) Field of Search ..... 440/84, 85; 307/10.2, 307/10.3; 180/287

(56) References Cited

U.S. PATENT DOCUMENTS

| | | | | |
|---|---|---|---|---|
| 4,107,543 A | * | 8/1978 | Kaplan | 180/287 |
| 4,196,418 A | | 4/1980 | Kip et al. | |
| 4,315,160 A | * | 2/1982 | Levine | 180/287 |
| 4,369,745 A | | 1/1983 | Howard | |
| 4,471,345 A | | 9/1984 | Barrett, Jr. | |
| 4,534,326 A | | 8/1985 | Bowcott | |
| 4,553,511 A | | 11/1985 | Hayakawa et al. | |
| 4,850,906 A | | 7/1989 | Kanno | |
| 4,917,061 A | | 4/1990 | Nagakura | |
| 4,941,854 A | | 7/1990 | Takahashi et al. | |
| 4,949,684 A | | 8/1990 | Gohara | |
| 5,069,174 A | | 12/1991 | Kanno | |
| 5,144,300 A | * | 9/1992 | Kanno | 123/198 DC |
| 5,171,171 A | | 12/1992 | Tani | |
| 5,593,330 A | | 1/1997 | Kobayashi | |
| 5,873,322 A | | 2/1999 | Koyanagi | |
| 5,952,940 A | | 9/1999 | Matsumoto | |
| 5,988,130 A | | 11/1999 | Nakamura | |
| 6,024,068 A | | 2/2000 | Nakase et al. | |
| 6,040,763 A | * | 3/2000 | Nakajima | 340/425.5 |
| 6,352,045 B1 | * | 3/2002 | Takashima | 114/55.5 |

FOREIGN PATENT DOCUMENTS

JP 62-128836 6/1987

OTHER PUBLICATIONS

U.S. patent application No. 09/670004 filed on Sep. 25, 2000 entitled Immobilization System for Watercraft in eighteen (18) pages and seven (7) sheets of formal drawings.
SeaDoo Shop Manual in three (3) pages.

* cited by examiner

*Primary Examiner*—Sherman Basinger
(74) *Attorney, Agent, or Firm*—Knobbe, Martens, Olson & Bear, LLP

(57) ABSTRACT

A watercraft includes an anti-theft switch which disables the starter button and provides a kill signal to the engine, thereby preventing unauthorized use and inadvertent draining of the battery.

14 Claims, 5 Drawing Sheets

ANTI-THEFT DEVICE FOR WATER VEHICLE

PRIORITY INFORMATION

This application is based on and claims priority to Japanese Patent Application No. 2001-028537 filed Feb. 5, 2001, the entire contents of which is hereby expressly incorporated by reference.

BACKGROUND OF THE INVENTION

1. Field of the Invention

The present invention generally relates to controls for vehicles. More specifically, the present invention relates to an anti-theft device for a water vehicle.

2. Related Art

The popularity of personal watercraft has increased over the last few decades. Unfortunately, this increase in popularity has also brought about an increase in personal watercraft theft.

In order to protect against personal watercraft theft, personal watercraft in the past have included a number of anti-theft devices. One of these devices is a lanyard switch which also functions as an emergency shut-off device. The lanyard switch includes a stop switch that protrudes from a handlebar assembly and a claw-shaped lanyard lock plate that engages the stop switch for allowing an ignition system of an engine to operate. The lock plate includes a cord and a wrist strap for attaching the lock plate to an operator's wrist or cloth for attaching the lock plate to the operator's clothing so that if the operator falls off the watercraft during operation, the lock plate will be disengaged from the stop switch so as to kill the engine.

This type of lanyard switch provides some anti-theft protection because the lock plate is required to engage the stop switch in order to start and operate the engine. The problem with using such a lanyard switch as the only means of anti-theft protection is that other plates and mechanisms can be substituted for a lock plate, thus allowing the engine to start and operate without using the lock plate originally supplied with the watercraft. As a result, this type of lanyard switch alone does not provide significant anti-theft protection.

Other watercraft have included a lanyard with a computer chip embedded therein which includes a unique identification number. The associated watercraft communicates with the computer chip to determine if the correct identification number is stored in the computer chip. An electronic controller within the watercraft is programmed to allow the engine to operate only if the correct lanyard is connected. If the correct lanyard is not connected, the controller does not allow the engine to operate. Other conventional watercraft have included a main switch connecting series between a battery used with a watercraft and an electronic control within the watercraft. The main switch is operable with a unique key. Thus, no power can reach the engine control of the watercraft unless the key is inserted in the main switch and turned to the proper orientation.

SUMMARY OF THE INVENTION

There are many circumstances under which the battery of a personal watercraft can be drained to a state where it can no longer start the engine of the watercraft. For example, during use, the batteries within the personal watercraft often become wet. Wetness on the battery can cause surface drain, i.e., the loss of electrical power due to the flow of electricity between the poles of the battery across the water and/or other deposits formed on the surface of the battery. Additionally, often during the operation of a personal watercraft, a rider may find it necessary to start, stop and re-start the engine numerous times without allowing the engine to run sufficiently long to recharge the battery, such as during docking maneuvers.

One aspect of the present invention includes the realization that watercraft and other vehicles that employ a key-operated main switch for connecting and disconnecting the main engine computer with the battery allows a user to inadvertently discharge the battery. For example, known watercraft, outboard motors, automobiles, and other vehicles, have been known to incorporate a main switch for connecting the engine and its associated control computer, with the battery. Automobiles use such systems in which a key is inserted into a master key cylinder and rotated through at least two positions. The first position connects the battery with the electrical system of the automobile. The second position energizes the starter motor. Once the engine begins to run, the key is returned to the first position at which time the control computer takes over and controls the operation of the engine. Similarly, known watercraft have included a key operated main switch connected in series between a battery and the engine controller. This switch has two positions, the first position which disconnects the controller from the battery, and a second position which connects the controller with the battery. If a user of either of these vehicles inadvertently leaves the key in the first position, i.e., with the battery connected to the engine controller, the battery can be inadvertently drained even though the engine is not operating.

In accordance with another aspect of the present invention, a watercraft includes a hull, a battery, an engine, and a starter motor configured to start the engine. The watercraft also includes an engine controller configured to control at least one of fuel supply and ignition for operation of the engine. A first user operable switch is configured to allow a user to selectively actuate an electrical circuit within a watercraft. A power supply for the controller is configured to supply power to the controller only after the first user operable switch is activated. Finally, the watercraft includes a third user operable switch movable between at least two positions. In a first position, the second user operable switch disables the first user operable switch such that the power supply will not supply power to the controller regardless of the actuation of the first user operable switch.

As such, the watercraft provides better protection against the inadvertent discharge of the battery. For example, since the power supply for the controller only supplies power to the engine controller after the first user operable switch is actuated, the battery will not be inadvertently discharged if the second user operable switch is left in the on position. Additionally, when the second user operable switch is in the second position, i.e., disabling the first user operable switch, the battery will not be discharged if another user, such as an unauthorized user, repeatedly pushes the start button. In this situation, no energy at all will flow to the engine controller. Thus, the present anti-theft system provides better protection against inadvertent battery discharge compared to those systems which use the controller to verify the presence of a digitally encoded security check.

Another aspect of the invention is directed to a watercraft having a hull and an engine having a crankshaft. A starter motor is configured to rotate the crankshaft. A starter relay powers the starter motor. A starter switch is configured to activate the starter relay. An engine controller is configured to control at least one of fuel supply and ignition for operation of the engine. A kill switch is configured to kill the engine. The watercraft also includes a third switch device comprising kill switch bypass switch, the kill switch bypass switch is disposed remotely from the starter relay.

A further aspect of the present invention is directed to an electrical system for a vehicle having an engine. The electrical system includes a power source, an engine controller configured to control at least one operational parameter of the engine, a user-operable start switch and a user-operable kill switch. The electrical system also includes a third user-operable switch device configured to disable the start switch and bypass the kill switch when in a first state and enable both the start switch and kill switch when in a second state.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENTS OF THE INVENTION

Figure 1:
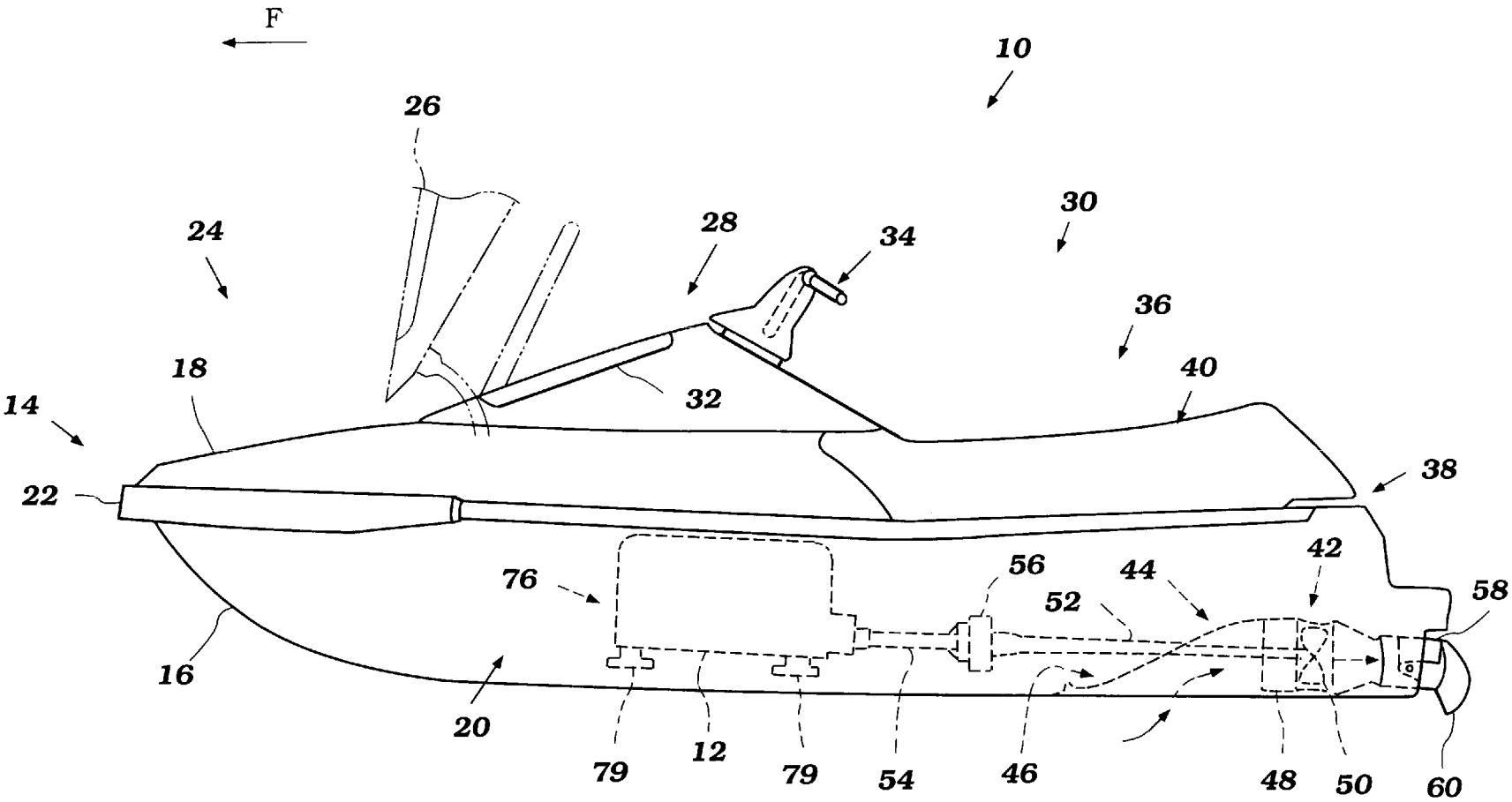
FIG. 1 is a side elevational view of the watercraft constructed in accordance with the present invention, with certain components such as an engine and a jet propulsion device shown in phantom.
Figure 2:
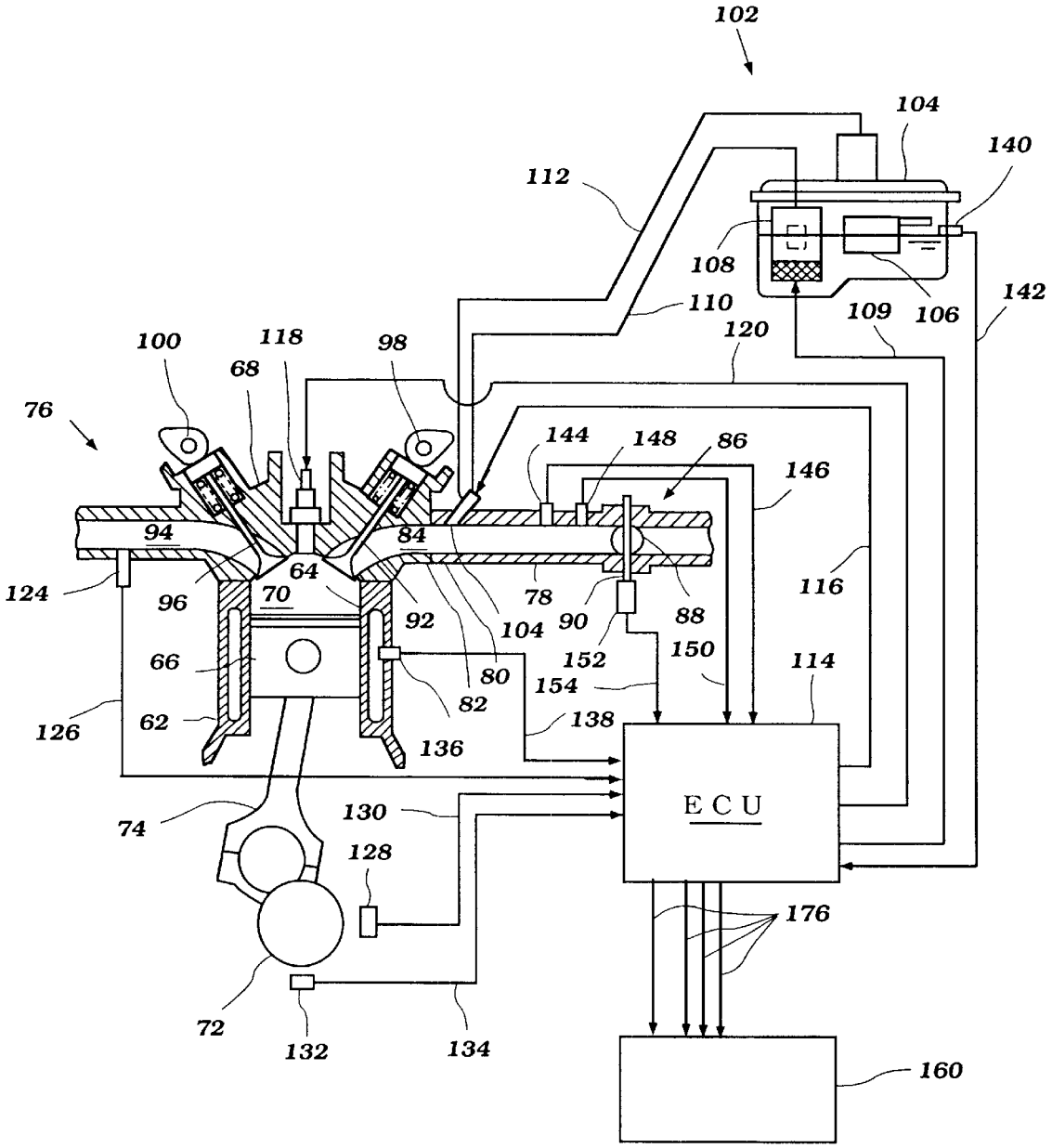
FIG. 2 is a schematic illustration of the engine included in the watercraft shown in FIG. 1, the left-hand side of FIG. 2 showing a partial sectional view of one cylinder of the engine, the lower right-hand corner of FIG. 2 including an electronic control unit of the engine, and the upper-right hand corner illustrating a portion of the fuel supply system.
Figure 3:
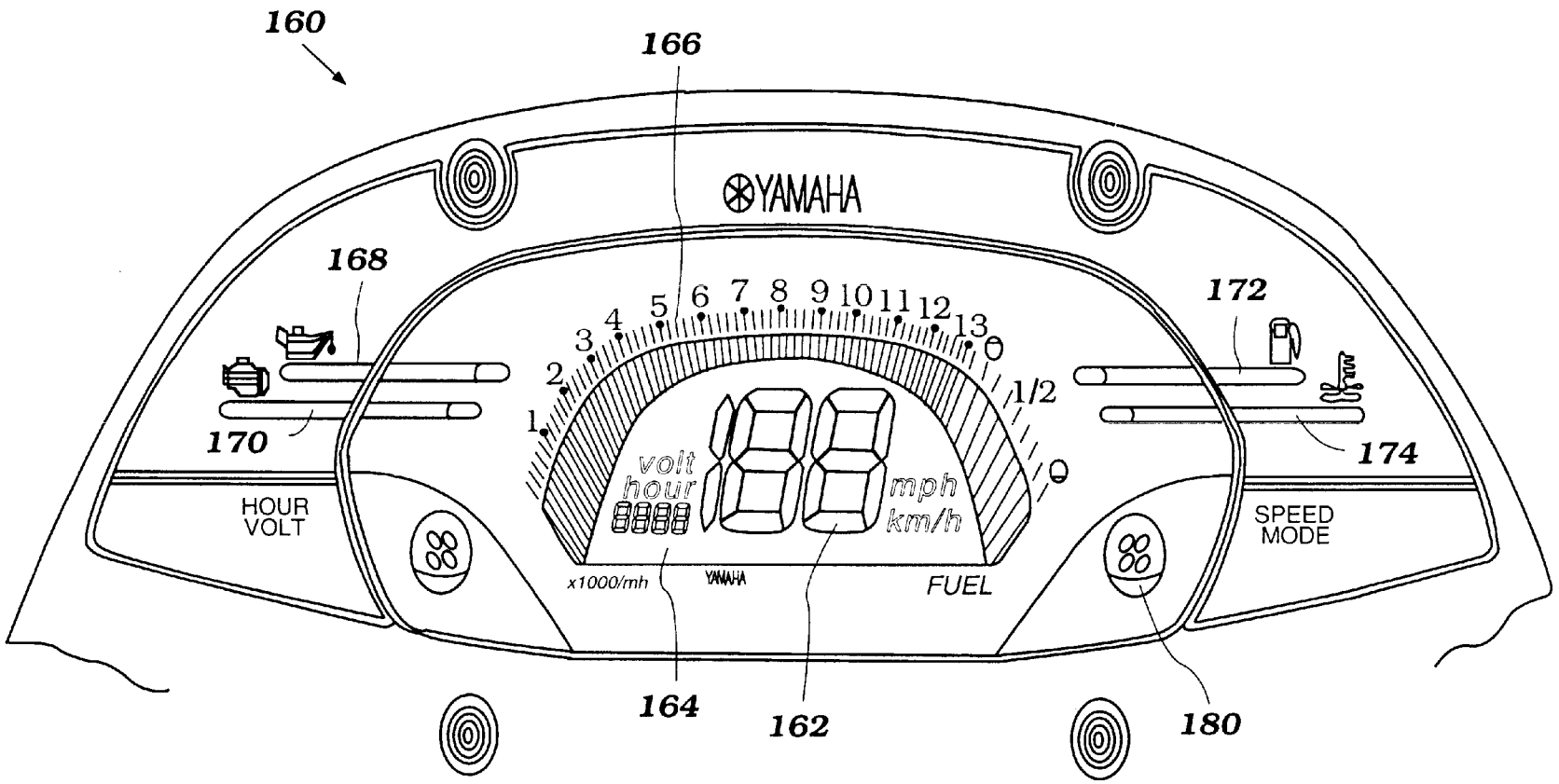
FIG. 3 is an enlarged rear elevational view of the control mast included on the watercraft in FIG. 1.

With reference now to FIGS. 1–3, an overall configuration of a personal watercraft 10 is described below. An arrow F shown in FIG. 1 indicates a forward direction of the watercraft 10.

The watercraft 10 includes an engine 12 and a hull 14 formed with a lower hull section 16 and an upper deck section 18. Both hull sections 16, 18 may be constructed of, for example, a molded fiberglass reinforced resin or a sheet molding compound. The hull section 16, 18 may, however, be constructed from a variety of other materials selected to make the watercraft lightweight and buoyant. The lower hull section 16 and upper hull section 18 are coupled together to define an internal cavity 20. A gunwale 22 defines an intersection of the lower and upper hull section 16, 18.

The hull 14 extends longitudinally and thereby generally defines a longitudinal axis (not shown). Along the longitudinal axis, in a direction from bow to stern of watercraft 10, the watercraft 10 includes a bow portion 24, a hatch cover 26, a control mast 28, and a rider's area 30.

In the illustrated embodiment, the bow portion 24 of the upper hull section 18 slopes upwardly and an opening 32 is provided through which a rider can access the internal cavity 20. The hatch cover 26 is detachably affixed (e.g., hinged) to the bow portion 24 so as to cover the opening 32.

The control mast 28 extends upwardly to support the handlebar 34. The handlebar 34 is provided primarily for controlling the direction in which the watercraft 10 travels. Grips (not shown) are formed at both ends of the bar 34 to aid the rider in controlling the direction of travel, and maintaining his or her balance on the watercraft 10. The handlebar 34 also carries other control devices such as, for example, a throttle lever (not shown) used to control a running condition of the engine 12, described in more detail below with reference to FIG. 4.

The rider's area 30 is defined primarily by a seat assembly 36. The seat assembly 36 is formed of a seat pedestal 38 which is defined by a portion of the upper deck portion 18. The pedestal 38 extends longitudinally along the hull and is shaped so that it can be straddled by a rider. Additionally, the pedestal 38 includes an access opening (not shown) through which a user can access the engine compartment 20.

The seat assembly 36 also includes a seat cushion 40 which is supported by the pedestal 38. Preferably, the seat 40 substantially seals the access opening when installed on the pedestal 38 so as to prevent water from entering the engine compartment 20. Additionally, foot areas are formed on each side of the seat assembly 36.

Preferably, the watercraft 10 includes at least one ventilation duct (not shown) for allowing atmospheric air to flow into the engine compartment 20 as well as allowing air from inside the engine compartment 20 to flow out to the atmosphere. Except for the ventilation ducts, the engine compartment 20 is substantially sealed during operations so as to prevent water from invading the engine compartment 20.

A jet pump 42 propels the watercraft 10. The jet pump 42 is mounted at least partially within a tunnel 44 formed on an underside of the lower hull section 16. The tunnel 44 has a downward facing inlet portion 46 opening towards the body of water in which the watercraft 10 is operating. A jet pump housing 48 is disposed within a portion of the tunnel 44 and communicates with the inlet port 46. An impeller 50 is supported within the housing 48.

An impeller shaft 52 extends forwardly from the impeller and is connected to a driveshaft 54 with a flexible coupling 56. The driveshaft 54 is driven by the engine 12.

The rear end of the housing 48 defines a discharge nozzle 58. A steering nozzle (not shown) is affixed to the discharge nozzle 58 pivotally for movements above a steering access which extends generally vertically. The steering nozzle through a bowden-wire assembly, for example, so that the rider can pivot the steering nozzle.

As the engine 12 drives the driveshaft 54 and thus the impeller shaft 52, the impeller is thereby rotated within the housing 48. The pressure generated in the housing 48 by the impeller 50 produces a jet of water that is discharged through the discharge nozzle 58 and the steering nozzle. This water jet propels the watercraft in a forward direction, as indicated by the arrow F. The rider can move the steering nozzle with the handlebar 34 when he or she desires to turn the watercraft 10.

Preferably, the watercraft 10 also includes a reverse bucket 60. The reverse bucket 60 is pivotally mounted relative to the discharge nozzle 58 so as to pivot about a generally horizontal axis. The reverse bucket 60 is shaped such that when it is placed in its full downward position, as illustrated in FIG. 1, water discharged from the discharge nozzle 58 will be directed downwardly and forwardly so as to cause reverse movement of the watercraft 10. In its upright position (not shown), the reverse bucket 60 allows the water to be discharged rearwardly from the discharge nozzle 58 and thus propel the watercraft in a forward direction F.

With reference to FIG. 2, the engine 12 operates on a four stroke combustion principle. The engine 12 includes cylinder block 62. The cylinder block defines at least one cylinder bore 64 therein. Preferably, the cylinder block 62 defines a plurality of cylinder bores 64 spaced from each other in a fore to aft direction along the longitudinal axis of the watercraft 10. Preferably, the cylinder block 62 defines four cylinder bores 64. Thus, the engine 12 is preferably an L4 (in-line four cylinder) type engine. The illustrated engine 12, however, merely exemplifies one type of engine that may include preferred embodiments of the anti-theft system. Engines having other numbers of cylinders, having other cylinder arrangements, other cylinder orientations (e.g., upright cylinder banks, V-type, and W-type) and operating on other combustion principles (e.g., crankcase compression two-stroke, diesel and rotary) are all practicable.

A piston 66 is slidably disposed in each cylinder bore 64. A cylinder head member 68 is affixed to the upper end of the cylinder block 62. The cylinder head member 68 closes the upper ends of the cylinder bores 64 and thereby defines four combustion chambers 70 along with the respective cylinder bores 64 and pistons 66.

A crankcase member (not shown) is affixed to the lower end of the cylinder block 62 to close the respective lower ends of the cylinder bores 64 and to define a crankcase chamber. A crankshaft 72 is rotatably connected to the pistons 66 through connecting rods 74 and is journaled at least partially within the crankcase. That is, the connecting rods 74 are rotatably coupled with the piston 66 and with the crankshaft 72.

The cylinder block 62, the cylinder head member 68, and the crankcase member, together define an engine body 76. The engine body 76 preferably is made of an aluminum-based alloy. In the illustrated embodiment, the engine body 76 is arranged in the engine compartment 20 to position the crankshaft 72 generally parallel to the longitudinal axis of the watercraft 10. Other orientations of the engine body 76, of course, are also possible (e.g., with a transverse or vertical crankshaft).

With reference to FIG. 1, engine mounts 79 extend from both sides of the engine body 76. The engine mounts 79 preferably include resilient portions made of, for example, a rubber material so that vibrations from the engine 12 are attenuated. The engine 12 is preferably mounted on a hull liner (not shown) that forms part of the lower hull section 16.

The engine 12 preferably is lubricated with oil housed in an oil tank (not shown). Preferably, the engine 12 includes a dry—sump lubrication system which, using plural oil pumps, circulates oil from the oil tank through a plurality of oil galleries defined within the engine body 76. The circulation path of the oil preferably passes through an oil filter (not shown) mounted on the engine body 76.

The engine 12 also includes an air induction system configured to guide air into the combustion chamber 70. In the illustrated embodiment, the air induction system includes at least one intake runner 78 for each combustion chamber 70 defined within the engine 12. Preferably, the intake runners 78 have an inlet end connected to an air plenum (not shown) disposed within the engine compartment 20. The outlet ends 80 of the intake runner 78 are connected to intake ports 82 defined on an outer surface of the cylinder head member 68. An internal air passages 84 extend from the inlet ports 82 to the combustion chamber 70.

The induction system also includes at least one throttle valve 86. Preferably, there is one throttle valve 86 for each intake runner 78. Each of the throttle valves 86 comprise a plate member 88 which defines a butterfly type valve with an interior surface of the intake runner 78. A throttle valve shaft 90 extends through the intake runner to rotatably support the plate 88. A portion of the runner 78 which supports the throttle valve shaft 90 can also be referred to as a "throttle body". The throttle valves 86 are connected to the throttle lever which is pivotally mounted on the handlebar 34. Thus, a rider can manipulate the throttle valve 86 by moving the throttle lever.

With continued reference to FIG. 2, the internal intake passages 84 are opened and close by intake valves 92. When the intake valves 92 are open, air from the intake runner 78 flows into the combustion chamber 70, during a downward movement of the piston 66.

In operation, the engine 12 draws air from the engine compartment 20 into the combustion chamber 70 during the downward movement of the piston 66. The throttle valve 86 controls the amount of air flowing into the intake runners 78 and eventually entering the combustion chamber 70. When the throttle valves 86 are closed, only a small amount of air enters each combustion chamber 70. Preferably, the throttle valves 86 are configured to allow a predetermined amount of air to flow through the intake runner 78 into the combustion chamber 70 when they are fully closed. Alternatively, one or a plurality of idle air passages (not shown) can be included which allows an idle amount of air to bypass the throttle valves 86 and flow into the combustion chambers 70.

The engine 12 also includes an exhaust system configured to guide burnt fuel charges from the combustion chamber 70 to the atmosphere. Exhaust gases are discharged from the combustion chamber 70 during upward movement of the piston 66. The exhaust gases travel out of the combustion chamber 70 into an internal exhaust gas passage 94 defined in the cylinder head member 68. The exhaust gases then travel out through an exhaust port (not shown) and through plurality of exhaust pipes, mufflers, and other components to the atmosphere.

At least one exhaust valve 96 opens and closes during the operation of the engine 12 and controls the flow of exhaust gases from the combustion chamber 70 into the exhaust passage 94.

An intake camshaft 98 and an exhaust camshaft 100 are provided to control the opening and closing of the exhaust valves 96 and the intake valves 92, respectively. The camshafts 98, 100 extend generally horizontally and parallel with each other. The camshafts 98, 100 have cam lobes that act against the valves 92, 96 at predetermined timings to open and close the respective internal passages 84, 94. The camshafts 98, 100 are journaled on the cylinder head member 68 and are driven by the crankshaft 72 via a camshaft drive unit (not shown).

With continued reference to FIG. 2, the engine 12 also includes a fuel injection system 102. The fuel injection system includes at least one fuel injector 104 for each combustion chamber 70. Each of the fuel injectors 104 includes an injection nozzle exposed to a portion of the air flow path into the combustion chamber 70. In the illustrated embodiment, the fuel injectors 104 are mounted in the intake runners 78 and are oriented so as to inject the fuel into an airflow flowing through the respective intake runners 78 towards the intake ports 84.

A main fuel supply tank (not shown) preferably is disposed in the engine compartment 20. Fuel is drawn from the fuel tank by a first low pressure pump (not shown) through a fuel line. The first low pressure pump pumps the fuel to a vapor separator assembly 104 through a fuel line (not shown). A float valve 106 is disposed within the vapor separator so as to maintain a uniform level of fuel contained within the vapor separator 104.

A high pressure fuel pump 108 preferably is disposed within the vapor separator 104 and pressurizes fuel within the vapor separator 104. The high pressure fuel pump 108 is connected with the fuel injectors 104 through a fuel delivery conduit 110. Preferably, the conduit 110 itself forms a fuel rail connecting the fuel injectors 104 with the high pressure fuel pump 108.

A fuel return conduit 112 connects the fuel injectors 104 and/or the fuel rail 110 with the vapor separator 104. Excess fuel that is not injected by the injectors 104 returns to the vapor separator 104 through the conduit 112. A pressure regulator (not shown) can be provided so as to communicate with either the fuel supply conduit 110 or the fuel return conduit 112 to limit the pressure of the fuel delivered to the fuel injectors 104. The flow generated by the return of unused fuel from the fuel injectors aids in cooling the fuel injectors 104.

The timing and duration of fuel injection from the fuel injectors 104 are controlled by an electronic control unit (ECU) 114. Preferably, each of the fuel injectors 104 are controlled by an electronic solenoid (not shown) which opens a valve at the discharge end of the fuel injector 104. The ECU 114 communicates with the solenoids on the fuel injectors 104 through a fuel injection communication line 116. Thus, the ECU 114 signals the solenoids on the fuel injectors 104 to open according to a timing determined by the ECU 114 and for duration also determined by the ECU 114.

The engine 12 also includes an ignition system. The ignition system includes at least one sparkplug 118 for each of the combustion chambers 70. The sparkplugs 118 are mounted such that an electrode of the sparkplug 118 is exposed to the respective combustion chamber 70. The sparkplugs 118 ignite an air fuel charge at a timing determined by the ECU 116 so as to cause the air fuel charge to burn therein. For this purpose, the ignition system includes an ignition coil (not shown) interposed between the sparkplugs 118 and the ECU 114. The ECU 114 controls the operation of the coil through an ignition control line 120.

The engine 12 also preferably includes an AC generator (not shown) for generating electrical power. Additionally, the watercraft 12 preferably includes a battery 122 (FIG. 4) for powering the ECU, as well as other components discussed in greater detail below, during the starting of the engine 12. The battery 122 is recharged with electrical energy from the AC generator.

As noted above, the ECU 114 controls engine operations including fuel injection from the fuel injectors 104 and firing of the sparkplugs 118, according to various control maps stored in the ECU 114. In order to determine appropriate control scenarios, the ECU 114 utilizes such maps and/or indices stored within the ECU 114 in reference to data collected from various sensors.

Any type of desired control strategy can be employed for controlling the time and duration of fuel injectors from the injectors 104 and the timing for firing sparkplugs 118; however, general discussion of some engine conditions that can be sensed and some of the ambient conditions that can be sensed for engine control will follow. Typically, fuel supply control strategies are configured to create stoichiometric air/fuel charges in the combustion chambers 70. It is to be understood, however, that those skilled in the art will readily understand how various control strategies can be employed in conjunction with the components of the invention.

The control for the air/fuel ratio preferably includes a feedback control system. Thus, an oxygen sensor 124 is mounted so as to detect a residual amount of oxygen in the combustion products approximately at a time when the exhaust valve 96 opens. An air/fuel data line 126 connects the oxygen sensor 124 with the ECU 114, and thus conducts a signal indicative of the air fuel ratio to the ECU 114.

With continued reference to FIG. 2, an engine speed sensor 128 is configured to detect a speed of the crankshaft 72 and produces a signal indicative of the speed of rotation of the crankshaft 72. An engine speed data line 130 connects the engine speed sensor 128 with the ECU 114.

Preferably, at least one crank angle position sensor 132 is provided for each combustion chamber 70. Each crank angle position sensor 132 is positioned around the crankshaft 72 so as to produce a signal indicative of the position of the crankshaft 72. Each crank angle position sensor 132 is connected to the ECU 114 with a crank angle position data line 134.

An engine temperature sensor 136 is connected to the cylinder block 62 so as to detect the temperature of coolant flowing through a water jacket disposed within the cylinder block 62. The engine temperature sensor 136 produces a signal indicative of the temperature of the coolant and transmits the signal to the ECU 114 via an engine temperature data line 138.

A fuel level sensor 140 is connected to the vapor separator 104 so as to detect a level of fuel within the vapor separator 104. The fuel level sensor 140 produces a signal indicative of the level of fuel within the vapor separator 104 and transmits this signal to the ECU 114 via a fuel level data line 142.

Although not illustrated, the ECU 114 can control the low pressure fuel pump in accordance with the signal received from the fuel level sensor 140 so as to maintain a uniform level of fuel within the vapor separator 104.

The engine can also include an intake air pressure sensor 144 disposed in the induction system. Preferably, at least one air pressure 144 is disposed in one of the intake runners 78 so as to detect an air pressure therein. The air pressure sensor 144 is configured to produce a signal indicative of the air pressure within the intake runner 78 and transmits this signal to the ECU via an air pressure data line 146.

At least one air temperature sensor 148 is also preferably disposed in one of the intake runners 78 so as to detect an air temperature therein. The air temperature sensor 148 produces a signal indicative of the air temperature within the intake runner 78 and transmits the signal to the ECU 114 via an air temperature data line 150.

A throttle position sensor 152 is configured to detect an opening amount of the throttle valve 86. In the illustrated embodiment, the throttle valve position sensor 152 is configured to detect an angular position of the throttle valve shaft 90 and produce a signal indicative of the angular position of the throttle valve shaft 90. The signal from the throttle valve position sensor 152 is transmitted to the ECU 114 via the throttle valve position data line 154.

The sensed conditions disclosed above are merely some of those conditions which may be sensed and applied for control of fuel injection and ignition. It is, of course, practical to provide other sensors such as, for example, without limitation, a knock sensor, a watercraft pitch sensor, an atmospheric temperature sensor, an atmospheric pressure sensor, a fuel pressure sensor, in accordance with the various control strategies.

The ECU 114 processes the detected signals from each sensor based upon a control strategy. The ECU 114 forwards control signals to the fuel injectors 104, sparkplugs 118, and the fuel pumps including the high pressure fuel pump 108 (via the high pressure control pump line 109) for their respective control.

With reference to FIGS. 1 and 3, a gauge panel 160 is positioned on the control mast so as to face an operator seated within the passengers area 30. As shown in FIG. 3, the gauge panel preferably includes plurality of instruments for providing information to the rider regarding the operational state of the watercraft 10.

In the illustrated embodiment, the gauge panel 160 includes a speedometer 162 a volt power meter 164, a tachometer 166, a lubricant pressure gauge 168, an engine error indicator 170, a fuel gauge 172, and an engine temperature gauge 174. The gauge panel 160 communicates with the ECU 114 via a plurality of data lines 176. The ECU 114 transmits signals to the gauges 162, 164, 166, 168, 170, 172, 174 for responding to the information gathered from the various sensors notes above.

With reference to FIG. 3, the gauge panel 160 also includes an anti-theft switch 180. The anti-theft switch 180 is moveable between two positions, described in greater detail below with reference to FIG. 4. The anti-theft switch 180 cooperates with the electrical system 182 (FIG. 4) of the watercraft 10.

Figure 4:
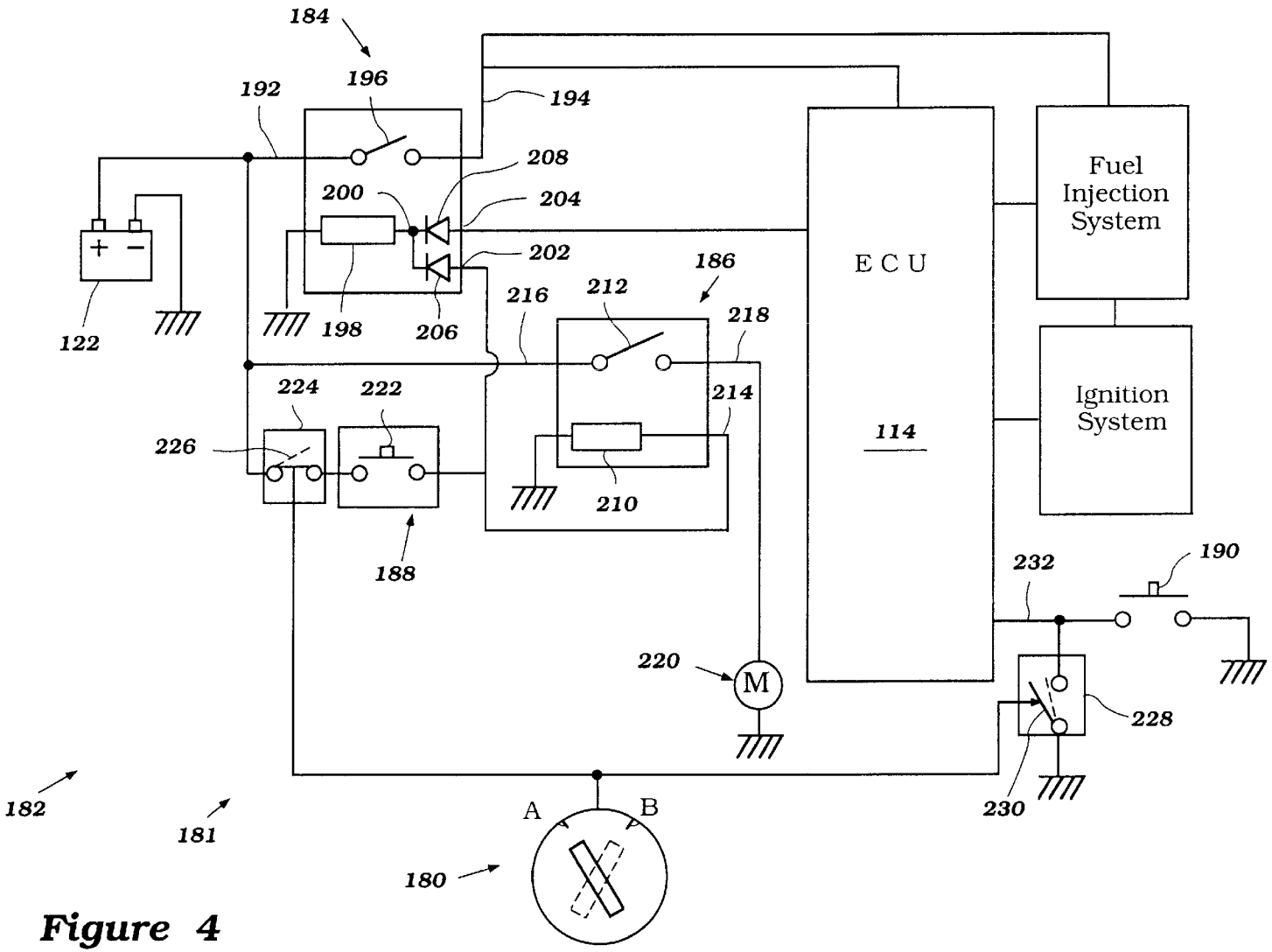
FIG. 4 is a schematic illustration of a power supply system of the watercraft illustrated in FIG. 1.

With reference to FIG. 4, the electrical system 182 generally includes the battery 122, an ECU power relay device 184, a starter motor power relay device 186, a user-operable starter switch 188, a user-operable kill switch 190, and a user-operable anti-theft device 181.

The ECU power supply relay device 184 includes an input 192 connected to the positive terminal of the battery 122. An output 194 of the relay device 184 is connected to the ECU 114, as well as the fuel injection and ignition systems. It should be noted that in FIG. 4, the fuel injection system and the ignition system are illustrated schematically. The relay device 184 also includes a switch 196. When the switch 196 is closed, the relay device 184 connects the positive terminal of the battery 122 with the ECU 114 and the fuel injection and ignition systems. When the switch 196 is open, no electrical power can flow from the battery 122 to the ECU 114 and the fuel injection and ignition systems.

The relay device 184 includes a relay 198. An input 200 of the relay 198 is connected to the ECU 114 as well as the starter relay device 186. The relay 198 is configured to control the operation of the switch 196. When the relay 198 is supplied with the predetermined input voltage at its input 200, the relay 198 closes the switch 196. When no voltage is applied to the input 200 of the relay 198, the relay 198 opens the switch 196.

As shown in FIG. 4, the input 200 is divided into two input terminals 202, 204. Each of the inputs 202, 204 include a diode 206, 208 respectively. The anode of the diode 206 is connected to the starter switch 188 and the starter relay device 186. The anode of the diode 208 is connected to the ECU 114. The cathodes of both diodes 206, 208 are connected to the input 200 of the relay 198.

The starter relay device 186 includes a relay 210 and a starter relay switch 212. A control input 214 of the relay device 186 is connected to the starter switch 188. A power input 216 of the relay device 186 is connected to the positive terminal of the battery 122. The relay 210 is configured to operate the switch 212. When the relay 210 is supplied with a predetermined input signal, the relay 210 closes the switch 212. When the switch 212 is closed, the input 216 is connected to a power output 218 of the relay device 186. Thus, in this state, the positive terminal of the battery 122 is connected to an input of the starter motor 220, which causes the starter motor 220 to rotate the crankshaft of the engine 12. When the relay 210 does not receive the predetermined input signal at its input 214, the relay 210 causes the switch 212 to open, thereby disconnecting the starter motor 220 from the battery 122.

The starter switch assembly 188 includes a switch member 222, which can be in the form of a button disposed on the handlebar 34 (FIG. 1). The starter switch 222 is biased to the open position, as schematically represented in FIG. 4. Thus, the input 214 of the starter relay device 186 is normally disconnected from the battery 122.

Similarly, the kill switch 190 can be in the form of a user-operable button disposed on the handlebar 34. Additionally the kill button 190 is in the form of a normally open switch, i.e., biased to the open position.

The anti-theft switch 180 is constructed of a magnetic type key cylinder movable at least between position A and position B (illustrated in phantom). Preferably, the anti-theft switch 180 requires a unique key to be inserted therein in order to move the anti-theft device 180 between position A and B. The anti-theft device 181 includes the anti-theft switch 180 and a switch device 224 which is configured to invalidate the starter switch device 188.

The switch device 224 includes a normally closed switch 226 connected in series between the positive terminal of the battery 122 and the input side of the starter switch device 188. The switch device 224 is configured such that when the anti-theft switch 180 is in position A (illustrated in solid line), the switch 226 is closed. Additionally, the switch 226 is configured such that when the anti-theft switch 180 is in position B (illustrated in phantom line), the switch 226 is open.

The anti-theft device 180 also includes a switch device 228 configured to bypass the kill switch 190. The switch device 228 includes a normally open switch 230. A kill signal detection terminal 232 of the ECU 114 is connected to both the kill switch 190 and the switch device 228. The switch device 228 is configured such that when the anti-theft switch 180 is in position A, the switch 230 is open. When the anti-theft switch 180 is in position B, the switch 230 is closed.

When a rider wishes to start the engine 12 of the watercraft 10, the rider will insert a unique key into the anti-theft switch 180 and move the anti-theft switch 180 to position A. As noted above, when the anti-theft switch 180 is in position A, the switch 226 is closed and the switch 230 is open.

The user will then depress the starter button 222, thereby "activating" the starter button. When the starter button 222 is depressed, thereby closing the switch device 188, the positive terminal of the battery 122 is connected with the input 214 of the relay 210 as well as the input 202 of the power relay device 184. With the battery 122 connected to the relay 210, the relay 210 causes the switch 212 to close thereby connecting the input 216 to the output 218, which thereby connects the starter motor 220 directly to the battery 122. Thus, the starter motor 220 will begin to rotate the crankshaft 72 as soon as the switch 212 closes.

Because the output of the switch device 188 is also connected to the input 202, power is supplied to the relay 198 through the diode 206. With power supplied to the relay 198, the switch 196 is closed thereby connecting the input 192 with the output 194 which, in turn, connects the positive terminal of the battery 122 with the ECU 114, the fuel injection system and the ignition system. When the ECU 114 receives power from the battery 122, the ECU 114 also outputs a signal to the input 204. Thus, when the starter switch device 188 is closed, the relay 198 receives power both from the starter switch device 188 and the ECU 114.

After the engine has started, the user releases the starter switch 222. When the starter switch device 188 is open, the relay 210 is disconnected from the battery 122, thus causing the switch 212 to open. Additionally, the input 202 is also disconnected from the battery 122. Because of the orientation of the diode 206, the positive signal cannot pass from the input 200 to the input 214 of the relay 210. Thus, when the engine is running and an output signal is transmitted from the ECU 114 to the input 204, the signal does not reach the relay 210. Thus, the switch 212 remains open thus allowing the starter motor 220 to stop rotating.

When the user wishes to kill the engine, the user depresses the kill button 190. When the kill switch 190 is closed, the kill signal detection terminal 232 is connected to ground. The ECU 114 is configured to kill the engine 12 by stopping or retarding all ignition signals to the ignition system and/or retarding or stopping signals to the fuel injection system. Additionally, the ECU is configured to terminate the power signal transmitted to the input 204 of the power relay device 184. Thus, because no power is being supplied to the relay 198, the relay 198 causes the switch 196 to open, thereby cutting off all power from the battery 122 to the ECU 114, the fuel injection system, and the ignition system.

Advantageously, when the anti-theft device 180 is in position A, no power is being supplied to the ECU 114, the fuel injection system, the ignition system, or any other device in the electrical system 182. Thus, if a user inadvertently leaves the anti-theft device 180 in the position A, the battery 122 will no be drained by the ECU 114, the fuel injection system or the ignition system.

When a user wishes to prevent unauthorized use of the watercraft 10, for example, if the user docks the watercraft 10 and leaves it unattended, the user switches the anti-theft device 180 to position B (illustrated in phantom). As noted above, when the anti-theft device 180 is in position B, the switch device 224 is configured to move the switch 226 to an open position. Additionally, the switch device 228 causes the switch 230 to move to the closed position. As such, the starter switch device 188 is completely disabled. Additionally, the kill signal input terminal 232, the ECU 114 is grounded regardless of the position of the kill switch 190. As such, the watercraft 10 can not be started by depressing starter button 222.

One aspect of the present invention includes the realization that the starter relay of typical watercraft can easily be directly connected to the battery of the watercraft. For example, if one desires to crank the starter motor of a watercraft, one can simply connect the positive terminal of the battery with the input of a starter relay. As such, an associated starter motor will crank thereby allowing the engine to be started.

However, because the anti-theft device 180 includes a switch device 228, the kill signal detection terminal 232 will continue to be connected to ground, even if someone can directly connect the input 214 of the starter relay device 186 to the battery 122. Thus, as noted above, the ECU 114 will not allow the engine 12 to start. In order to defeat the anti-theft device 180, one would have to disconnect the switch device 228 from the kill signal detection terminal 232. Preferably, the switch device 228 is disposed remotely from the starter relay device 186, thereby making it more difficult for one to discover the location of the switch device 228 and making it more difficult to operate the watercraft 10 without authorization.

Figure 5:
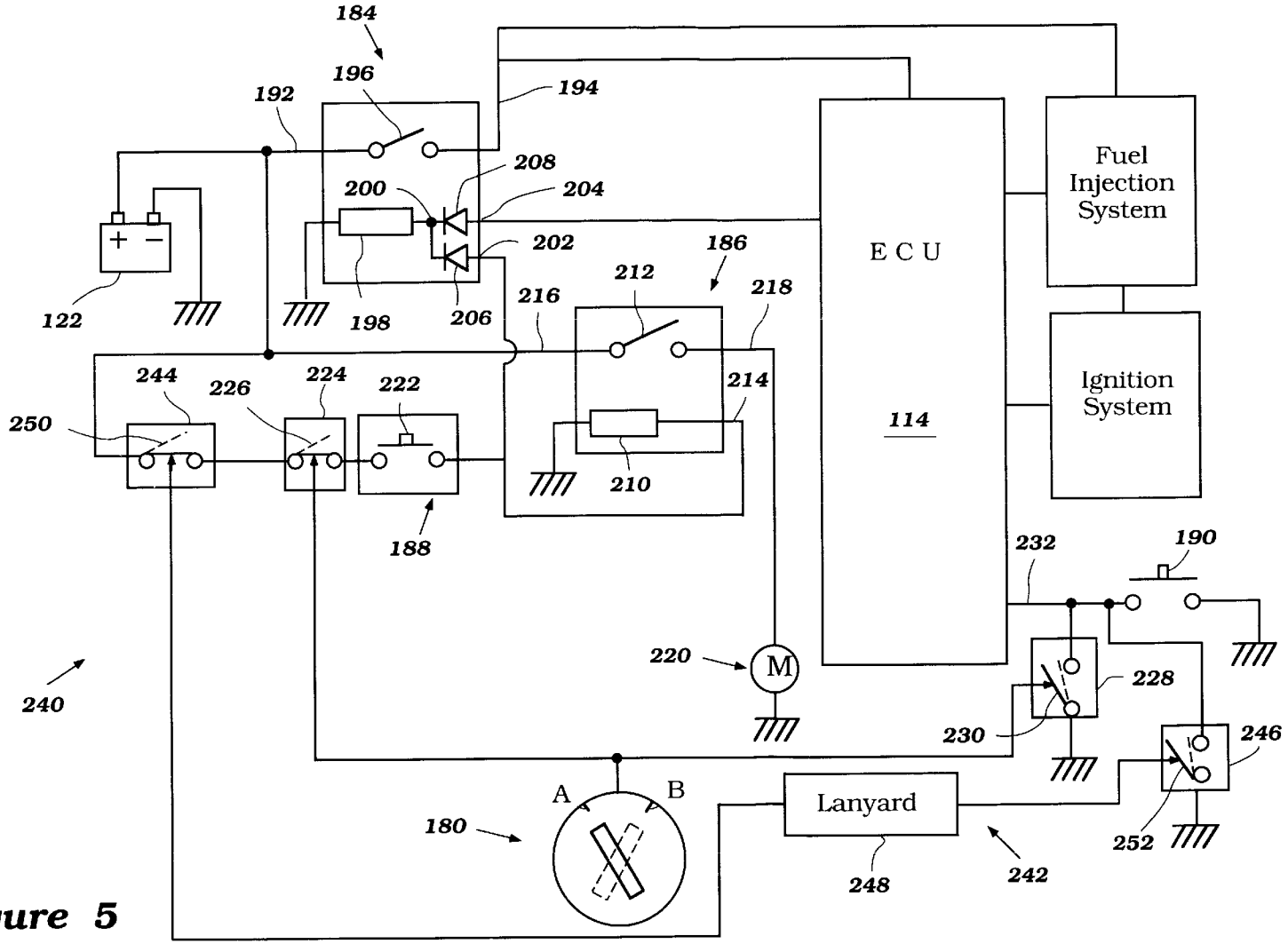
FIG. 5 is a schematic illustration of a modification to the power supply system of the watercraft illustrated in FIG. 1.

With reference to FIG. 5, a modification of the electrical system 182 is disclosed therein. Because the electrical system shown in FIG. 5 includes many of the same components of the electrical system 182 illustrated in FIG. 4, identical reference numerals will be used to identify identical components and will not be further described.

The electrical system 240 illustrated in FIG. 5, in addition to all the components of the electrical system 182 illustrated in FIG. 4, includes a lanyard system 242. The lanyard system 242 includes starter switch invalidation device 244, a kill switch bypass device 246, and a lanyard 248.

The lanyard can be constructed in a known manner, for example, a strap having an engagement device for connecting to the body or clothing of a rider. Preferably, the strap also connects to a device on the handlebar 34. The lanyard is configured such that when a rider falls off the watercraft 10, the lanyard 248 remains connected to the rider and releases from the coupling on the handlebar 34.

The starter switch invalidation device 244 includes a switch 250 which is normally closed when the lanyard device is connected to the coupling on the handlebar 34. The kill switch bypass device 246 includes a switch 252 which is normally open when the lanyard is connected to the coupling device on the handlebar 34. Thus, when the lanyard is connected to the coupling device on the handlebar 34, the electrical system 240 operates identically to the electrical system 182 illustrated in FIG. 4 when the anti-theft switch 180 is in position A. However, when the lanyard device is disconnected from the coupling on the handlebar 34, the switch 250 moves to the open position and the switch 252 moves to the closed position. Thus, in this state, the electrical system 240 operates identically to the behavior of the electrical system 182 when the anti-theft switch 180 is in position B.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A watercraft comprising a hull, a battery, an engine having a crankshaft, a starter motor configured to rotate the crankshaft, a starter switch moveable between at least first and second positions, a starter circuit configured to connect the battery with the starter motor when the starter switch is in the first position and to disconnect the battery from the starter motor when the starter switch is in the second position, an engine controller configured to control at least one of fuel supply and ignition for operation of the engine, a kill switch moveable between at least first and second positions, a kill circuit configured to prevent operation of the controller when the kill switch is in the first position and to allow operation of the controller when the kill switch is in the second position, a third switch moveable between at least first and second positions, and a third circuit configured to disable the starter circuit regardless of the position of the start switch and to actuate the kill circuit regardless of the position of the kill switch when the third switch is in the first position.

2. The watercraft set forth in claim 1, wherein the third circuit comprises a starter portion and a kill portion, the kill portion being disposed separately from the starter portion.

3. The watercraft set forth in claim 1, wherein the third circuit comprises a fourth switch disposed in the starter circuit and a fifth switch communicating with the kill circuit.

4. The watercraft set forth in claim 3, wherein the third switch is a user-operable switch assembly and is configured to control the fourth and fifth switches.

5. The watercraft set forth in claim 1, wherein the controller comprises at least a first input, the controller being configured to terminate operation of at least one of the fuel supply and ignition when the first input receives a predetermined input value.

6. The watercraft set forth in claim 5, wherein the first predetermined input value is ground.

7. The watercraft set forth in claim 5 additionally comprising a power circuit for the controller, the power circuit configured to initiate power supply to the controller when the start switch is moved to the first position.

8. A watercraft comprising a hull, an engine having a crankshaft, a starter motor configured to rotate the crankshaft, a starter switch moveable between at least first and second positions, a starter circuit configured to operate the starter motor when the starter switch is in the first position and to prevent operation of the starter motor when the starter switch is in the second position, an engine controller configured to control at least one of fuel supply and ignition for operation of the engine, a kill switch moveable between at least first and second positions, a kill circuit configured to prevent operation of the controller when the kill switch is in the first position and to allow operation of the controller when the kill switch is in the second position, and third user-operable switch device comprising means for disabling the starter circuit and bypassing the kill circuit when the third switch device is in a first state.

9. The watercraft set forth in claim 8 wherein the means for disabling and bypassing is not activated when the third user-operable switch device is in a second state.

10. A watercraft comprising a hull, an engine having a crankshaft, a starter motor configured to rotate the crankshaft, a starter relay powering the starter motor, a starter switch configured to activate the starter relay, an engine controller configured to control at least one of fuel supply and ignition for operation of the engine, a kill switch configured to kill the engine, a third switch device comprising kill switch bypass switch, the kill switch bypass switch being disposed remotely from the starter relay, and a rider's area supported by the hull, the third switch device including a user-operable switch disposed in the rider's area.

11. An electrical system for a vehicle having an engine, the electrical system comprising a power source, an engine controller configured to control at least one operational parameter of the engine, a user-operable start switch, a user-operable kill switch, and a third user-operable switch device configured to disable the start switch and bypass the kill switch when in a first state and enable both the start switch and kill switch when in a second state.

12. The electrical system according to claim 11, wherein the third user-operable switch device is configured such that when the engine is not running, when the start switch is not activated, and when the third user-operable switch device is in the second state, electrical power is not supplied from the battery to the controller.

13. The electrical system according to claim 11 additionally comprising a starter relay and a controller power relay connected to the starter switch, the starter switch being configured to connect the power source with both the starter relay and the controller power relay when the starter switch is activated.

14. The electrical system according to claim 13, wherein the controller power relay is configured to connect the power source with the controller, the controller including a power output connected to the controller power relay.

* * * * *